US006559599B1

(12) United States Patent
Cooch et al.

(10) Patent No.: US 6,559,599 B1
(45) Date of Patent: May 6, 2003

(54) INTERNALLY CHANNELED GLASS ENVELOPE WITH MOLDED EDGE FOR AFFIXING ATTACHMENTS

(75) Inventors: Stephen L. Cooch, Big Flats, NY (US); Edwin Q. Giles, Beaver Dams, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/440,974

(22) Filed: Nov. 16, 1999

Related U.S. Application Data

(60) Provisional application No. 60/117,870, filed on Jan. 29, 1999, and provisional application No. 60/108,750, filed on Nov. 17, 1998.

(51) Int. Cl.[7] ..... H01J 17/16; H01J 51/33

(52) U.S. Cl. ..... 313/634; 313/493

(58) Field of Search ..... 313/493, 607, 313/610, 634

(56) References Cited

U.S. PATENT DOCUMENTS

| | | | | | |
|---|---|---|---|---|---|
| 2,255,431 | A | * | 9/1941 | Marden et al. | 313/493 |
| 2,446,712 | A | * | 8/1948 | McIlvaine | 313/610 |
| 3,226,590 | A | * | 12/1965 | Christy | 313/493 |
| 3,247,415 | A | * | 4/1966 | Martyny | 313/493 |
| 3,253,175 | A | * | 5/1966 | Holle | 313/493 |
| 3,253,176 | A | * | 5/1966 | Pate et al. | 313/493 |
| 3,646,383 | A | * | 2/1972 | Jones et al. | 313/493 |
| 4,272,702 | A | * | 6/1981 | Teshima et al. | 313/493 |
| 4,454,448 | A | * | 6/1984 | Roberts | 313/493 |
| 4,879,489 | A | * | 11/1989 | Goudy, Jr. | 313/634 |
| 5,049,777 | A | * | 9/1991 | Mechtersheimer | 313/607 |
| 5,070,273 | A | * | 12/1991 | van den Bogert et al. | 313/607 |
| 5,500,574 | A | * | 3/1996 | Popov et al. | 313/634 |
| 5,717,284 | A | * | 2/1998 | Anandan et al. | 313/493 |
| 5,811,925 | A | * | 9/1998 | Anandan et al. | 313/493 |
| 5,834,888 | A | | 11/1998 | Allen et al. | 313/484 |
| 5,858,046 | A | | 1/1999 | Allen et al. | 65/66 |
| 5,903,090 | A | * | 5/1999 | Haag | 313/493 |
| 5,956,109 | A | * | 9/1999 | Jung | 349/110 |
| 6,127,780 | A | * | 10/2000 | Winsor | 313/493 |
| 6,323,593 | B1 | * | 11/2001 | Anderson et al. | 313/493 |
| 6,489,717 | B1 | * | 12/2002 | Allen | 313/493 |

FOREIGN PATENT DOCUMENTS

| | | | |
|---|---|---|---|
| WO | WO 99/49493 | 9/1999 | H01J/11/00 |

* cited by examiner

*Primary Examiner*—Michael H. Day
(74) *Attorney, Agent, or Firm*—Anca C. Gheorghiu; Siwen Chen; Timothy M. Schaeberle

(57) ABSTRACT

The present invention is directed towards a thin, flat glass envelope having an enclosed, internal channel and a molded edge for affixing attachments directly to the glass envelope. Suitable attachments include filters, i.e., diffusion, polarizing, glare reducing, brightness enhancing, liquid crystal display screens and masking components. The channeled envelope has a front and a back surface laminated and integrated together to form a unitary body essentially free of any sealing materials. A lightweight, light-emitting device or low-pressure discharge lamp can be formed from this channeled envelope, suitable for employment in the fields of LCD backlighting, automotive lighting, and general lighting.

17 Claims, 3 Drawing Sheets

INTERNALLY CHANNELED GLASS ENVELOPE WITH MOLDED EDGE FOR AFFIXING ATTACHMENTS

This application claims the benefit of U.S. Supplemental Provisional Application, Ser. No. 60/117,870, filed Jan. 29, 1999 entitled INTERNALLY CHANNELED GLASS ENVELOPE WITH MOLDED EDGE FOR AFFIXING ATTACHMENTS, by Cooch et al., and U.S. Provisional Application, Ser. No. 60/108,750, filed Nov. 17, 1998 entitled GLASS SUBSTRATES WITH MOLDED FILTER SUPPORTS, by Cooch et al.

BACKGROUND OF THE INVENTION

1. Field of Invention

Generally, the present invention relates to a glass envelope for a light emitting device, particularly to a flat glass envelope having an internal channel and a molded edge for facilitating attachments, for instance for supporting filters.

2. Description of Related Art

Light emitting devices or discharge lamps having an envelope with an enclosed, internal channel have been disclosed. Such envelopes are commonly formed from glass, are evacuated, and backfilled with an ionizable gas. Generally, internally channeled envelopes have been formed by cutting channels in a bottom glass plate. The channels may be formed by grinding, etching, sandblasting, or otherwise hollowing out a desired pattern in the plate. A top planar plate is then sealed, as with a sealing paste or a glass frit, to the bottom plate to form an enclosed channel.

Recently, a more efficient process and the glass envelope thereby produced has been disclosed in U.S. Pat. No. 5,834,888 (Allen et al.) and U.S. Pat. No. 5,858,046 (Allen et al.). The teachings of the above referenced patents are incorporated herein in their entirety. The method disclosed comprises successively delivering two sheets from a source of glass. A first glass sheet is delivered to a mold assembly having the desired channel forming pattern and a peripheral surface which the glass sheet overlies. The glass sheet may be caused to conform to the mold by the force of gravity, by drawing a vacuum, or by a combination of these forces. The second sheet is then delivered over the conformed, bottom sheet at a viscosity such that it hermetically seals to the raised portion of the bottom sheet, but does not sag into the channels of the mold. This provides a laminated, internally channeled, lightweight envelope in an efficient manner.

Still another method for forming discharge lighting devices has been disclosed in U.S. Patent Appl., having Ser. No. 09/308,554, and title "Method For Forming An Internally Channeled Glass Article" (Allen et al.), which is issued as U.S. Pat. No. 6,301,932, co-assigned to the instant assignee, and herein incorporated by reference. The method comprises delivering one sheet of molten glass from one source of glass. Briefly, upon exiting the rollers, first length of the molten glass ribbon is deposited upon the mold which is moved along a predetermined path, preferably a direction along the mold's width; although the molten ribbon could be deposited in a direction along the mold's length. Following the conformance of the first length to the mold cavity, through either gravity or vacuum forming or a combination of the two, the mold is thereafter moved back along a second predetermined path opposite the first direction and a second length of the molten glass is laid onto the first length of molten glass. In other words, second length of the molten glass ribbon is essentially folded over and onto first length of the molten glass ribbon.

Discharge lamps of the type described herein above find employment in such diverse areas as the automotive field, particularly in rear lighting applications, general lighting and liquid crystal display (LCD) backlighting. Often there exists the need to attach filters to such lighting devices. However, in order to accomplish such connections a separate device is needed which accommodates the discharge lamp and any other desired attachments.

Therefore, it is an object of the present invention to more easily facilitate the union of a discharge lamp with attachments, for example a filter, by eliminating the need for a separate device to affect this task.

It is also another object of the present invention to simplify discharge lamp product design.

SUMMARY OF THE INVENTION

According to the present invention, these and other objects and advantages are achieved in a glass envelope having an enclosed, internal channel and a molded edge for facilitating attachments directly to the glass envelope thereby eliminating the need for additional devices to connect said several components.

The molded edge could accommodate such diverse attachments as filters (i.e., diffusion, polarizing, and glare reducing), and liquid crystal display (LCD) screens, and masking components.

Lightweight, light-emitting sources or low-pressure discharge lamps may be formed from the glass envelopes of the present invention. The discharge lamps may be employed in the fields of automotive lighting, general lighting and LCD backlighting. Often filters are desired to modify or improve the source of light, i.e., direct light in different directions or render a brighter light. Since the present invention does not require a separate device to accommodate the lamp and filter because the filter can be attached directly to the glass envelope, there results a simplified product that provides more flexibility in terms of design options at the same time offering more cost effective options.

Furthermore, in addition to filters other attachments such as liquid crystal display screens may be attached to the glass envelope at the molded edge. It is well known that liquid crystal displays (LCD) require backlighting. The molded edge could be formed to accommodate an LCD screen, whereby the discharge lamp would serve as backlighting source.

DETAILED DESCRIPTION OF THE PREFERRED EMBODIMENTS

Figure 1:
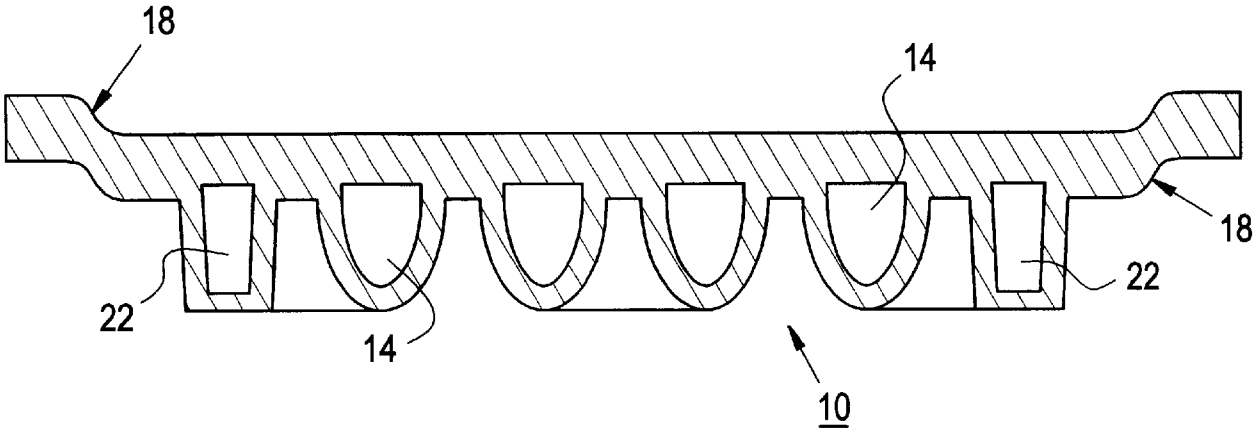
FIG. 1 illustrates a cross-section of a glass envelope having an enclosed, internal channel and a molded edge.

FIG. 1 presents a cross-sectional view of a channeled envelope 10. As discussed herein above, the method disclosed in U.S. Pat. No. 5,834,888 (Allen et al.) and U.S. Pat. No. 5,858,046 (Allen et al.) may be employed in the manufacturing of the glass envelopes of the present invention. The method comprises the following general steps: (a) delivering a first or channel-forming ribbon of molten glass to a surface of a mold assembly having a mold cavity possessing at least one channel-forming groove formed therewithin and a peripheral surface, wherein the channel-forming ribbon overlies the mold cavity and the peripheral surface of the mold assembly; (b) causing the channel-forming ribbon of molten glass to substantially conform to the contour of the mold cavity resulting in the formation of at least one channel in the channel-forming ribbon of the molten glass; (c) delivering and depositing a second or sealing ribbon of molten glass to the outer surface of the channel-forming ribbon of molten glass wherein the viscosity of the sealing ribbon is such that the sealing ribbon of molten glass bridges but does not sag into contact with the surface of channel-forming ribbon in the channel-forming mold cavity, but is still molten enough to form an hermetic seal wherever the sealing ribbon contacts the channel-forming ribbon, thereby resulting in a glass article possessing at least one enclosed channel; and, (d) removing the glass article from the mold. Conformance of the channel-forming molten glass ribbon to the channel-forming mold cavity is attained by gravity forces, vacuum actuation or a combination of both. The glass envelope formed by the above described method comprises a front and a back surface laminated and integrated together to form a unitary body essentially free of any sealing materials. The glass envelope preferably exhibits a weight to area ratio of $\leqq 1.0$ g/cm$^2$.

Channeled envelope 10 (FIG. 1) comprises an enclosed, internal gas-discharge channel 14 and molded edge 18. Gas-discharge channel 14 comprises tubulation ports 22 located at opposites ends of the channel. The tubulation ports are in communication with both the external environment and the channel.

The term "molded edge" as used herein is that portion of the glass envelope that can accommodate a filter or another attachment.

In FIG. 1, the molded edge is a single step structure. This configuration allows for the insertion of an attachment, for example a filter, whereby the molded edge of the glass envelope supports the filter (not shown) at the edges of the filter, i.e., the filter would rest against the molded edge of the glass envelope opposite the gas-discharge channel 14. Suitable filters include but are not limited to filters for diffusion of light, enhancement of brightness, polarizing filters, glare-reducing filters and light focusing or spreading filters.

A key aspect of the present invention is that the molded edge 18 is integral with channeled envelope 10. As such, the glass channeled envelope forming process, herein above described, requires modification to allow for the simultaneous formation of the molded edge to be integral with the channeled glass envelope. This can be achieved by modifying the peripheral surface of the mold to include a molded-edge forming grove, whereby there is simultaneous formation of a glass channeled envelope with a molded edge. The molded edge may be formed to be a continues structure encompassing the glass envelope, or a partial structure positioned in enough locations to support the filter or attachment.

As it is shown in FIG. 1, molded edge 18 and gas-discharge channel 14 are on opposite surfaces of the glass envelope, whereby an inserted filter would be positioned opposite the gas-discharge channel; however, the molded edge may be formed to exist on the same surface as the gas-discharge channel, whereby an inserted filter would be on the same side as the gas-discharge channel, and would rest above, but not touch the gas-discharge channel.

Channeled envelope 10 is composed of a transparent material selected from the group of glasses consisting of soda-lime silicate, borosilicate, aluminosilicate, boro-aluminosilicate and the like.

Figure 2:
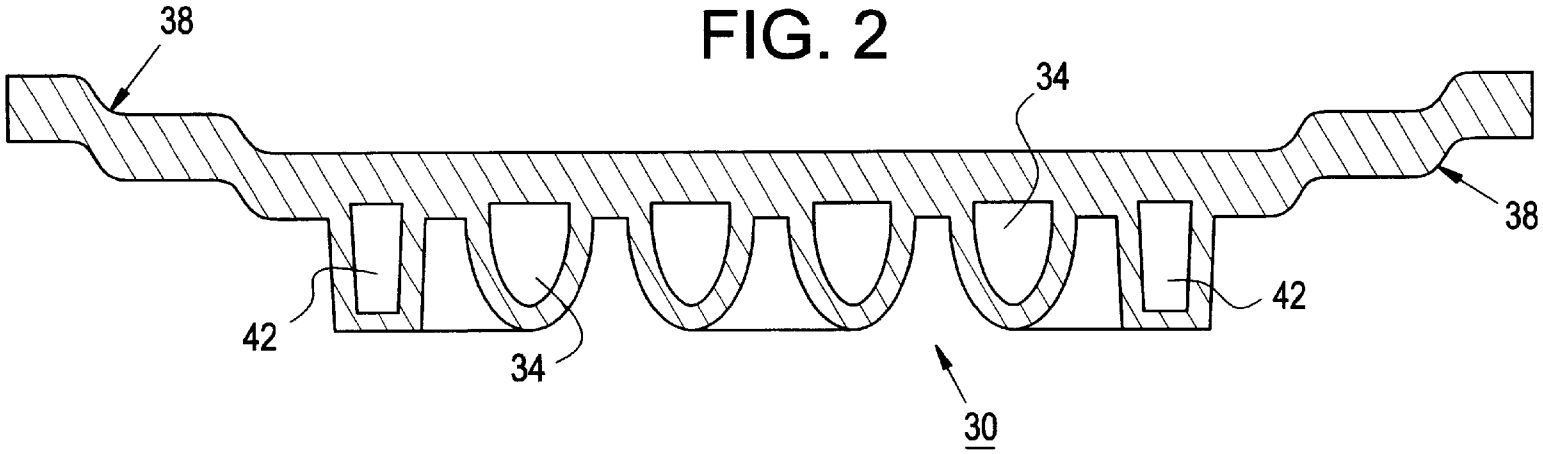
FIG. 2 illustrates a cross-section of another embodiment of a glass envelope having an enclosed, internal channel and a differently structured molded edge.

FIG. 2 illustrates another embodiment of a channeled envelope having a differently structured molded edge. Channeled envelope 30 comprises gas-discharge channel 34 and molded edge 38. Tubulation ports 42 are also shown. In this embodiment the molded edge 38 is a two-step structure. This configuration is suitable for affixing more than one attachment, for example, two filters or a filter and a masking screen, or a filter and an LCD screen if the glass envelope is used as a discharge lamp for LCD backlighting.

Figure 3:
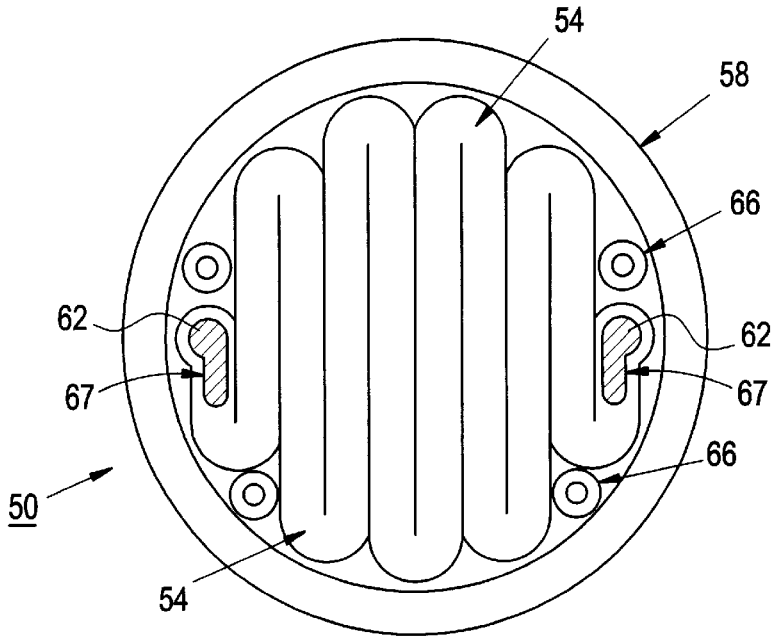
FIG. 3 illustrates a top-view of still another embodiment of a glass envelope having a molded edge and external electrodes.
Figure 3A:
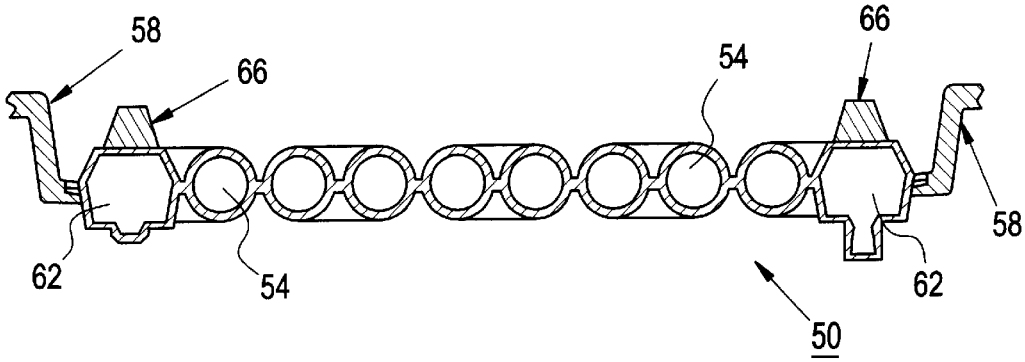
FIG. 3A illustrates a cross section of the glass envelope of FIG. 3.
Figure 4:
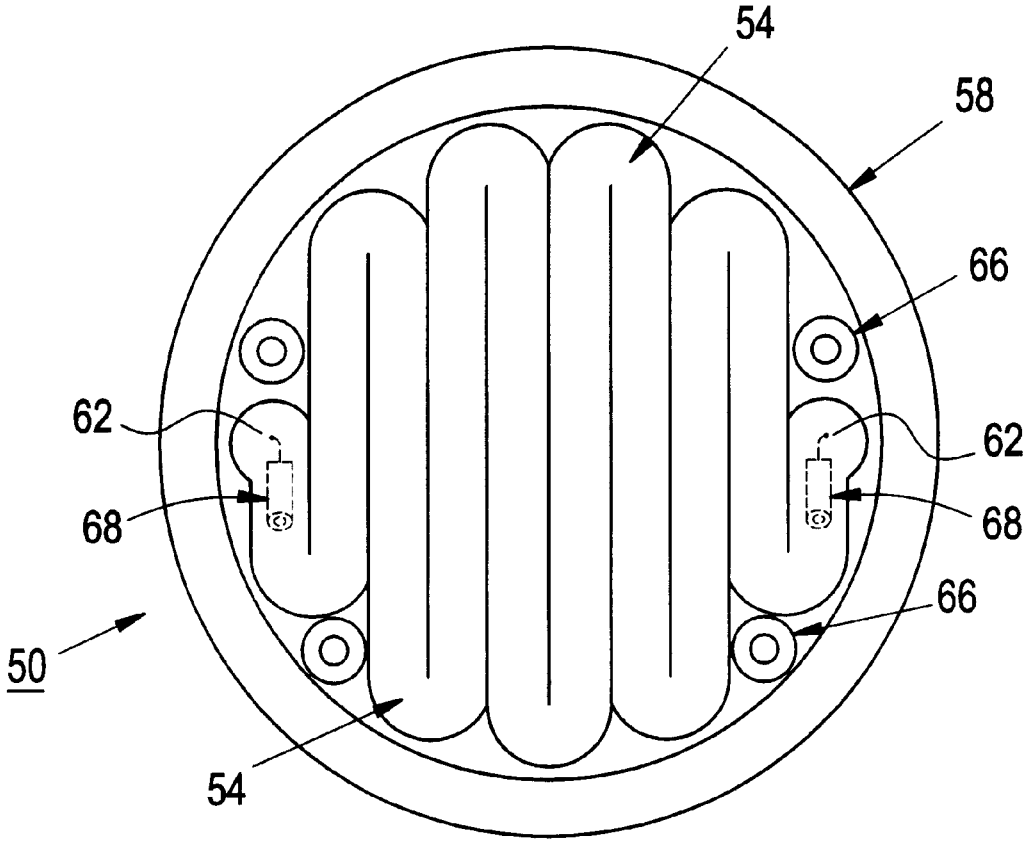
FIG. 4 illustrates a top-view of the embodiment of FIG. 3 having internal electrodes in place of the external electrodes.

FIGS. 3, 3A and 4 illustrate yet another embodiment of a channeled envelope having a molded edge. Channeled envelope 50 comprises gas-discharge channel 54 and molded edge 58. Tubulation ports 62 are also shown. The illustrated embodiment comprises a plurality of attachment supports 66. The attachment supports are integral to the channeled envelope and may be positioned between the molded edge and the area of the glass channeled envelope including the gas-discharge channel. The attachment supports may also be positioned in between the sections of the gas-discharge channel, provided that a mold is produced to accommodate such a design.

Attachment supports 66 provide structural integrity to filters or other attachments that are very thin and would otherwise deform if affixed to the embodiments of FIGS. 1 and 2. In order to allow for the simultaneous formation of a glass envelope with molded edge and attachment supports, the mold employed in the above method of formation would have to be modified to include attachment support-forming cavities or grooves, in addition to a molded-edge forming groove.

Lightweight, light-emitting devices may be formed from the channeled glass envelopes of FIGS. 1, 2, and 3. Electrodes may be attached, at opposite ends of, and in communication with the gas-discharge channel. The gas-discharge channel is evacuated and backfilled with an ionizable gas through the tubulation ports which are preferably located at opposite ends of, and in communication with said gas-discharge channel and the external environment. Any of the noble gases or mixtures thereof may be used for the ionizable gas, including but not limited to neon, xenon, krypton, argon, helium, and mixtures thereof with mercury; mercury alone may be used. Typically, the electrodes are internal as known in the art (shown as 68 in FIG. 4) and are attached to the tubulation ports or to other sites which are in communication with the gas-discharge channel, via a glass-to-glass seal, i.e., vacuum sealed to form discharge paths, whereby the electrodes are in electrical communication with the interior of gas-discharge channel. Alternatively, external electrodes (shown as 67 in FIG. 3) of the type described in co-pending PCT Serial No. PCT/US98/23722 and title "External Electrode Driven Discharge Lamp" (Trentelman), co-assigned to the instant assignee and herein incorporated by reference, may be employed.

Lastly, a means for activating the ionizable gas should be provided. Specifically, an alternating voltage (a high voltage AC) (not shown) is applied across the electrodes whereby a glow-discharge is generated therebetween in the gas-discharge channel.

In one embodiment, the light emitting device described herein above is a neon lamp. In another embodiment, a fluorescent lamp may be produced by coating the inner surfaces of the gas-discharge channel with a suitable activated powder phosphor and sending an electric current through mercury vapor, whereby ultraviolet light is emitted. As is well known the phosphor coating absorbs the ultraviolet light and reradiates at wavelengths visible to the human eye. Suitable phosphorescent chemicals include but are not limited to magnesium tungstate, calcium fluorochlorophosphate:antimony:manganese, manganese and lead activated calcium metasilicate, lead activated calcium tungstate, zinc orthoslicate:manganese and yttrium oxide:europium.

Although the now preferred embodiments of the invention have been set forth, it will be apparent to those skilled in the art that various changes and modifications may be made thereto without departing from the spirit and scope of the invention as set forth in the following claims.

What is claimed is:

1. A channeled glass envelope for use as a lighting device, said channeled glass envelope comprising a gas-discharge channel and a molded edge having a structure having at least one step and/or at least one part protruding upward and/or downward relative to the lamp body capable of affixing attachments, said channeled glass envelope comprising a front and a back surface laminated and integrated together to form a unitary body essentially free of any sealing materials, said edge being essentially the peripheral portion of the lamp envelope.

2. The channeled glass envelope of claim 1, wherein said molded edge is integral with said channeled glass envelope.

3. The channeled glass envelope of claim 2, wherein said molded edge has a single step structure.

4. The channeled glass envelope of claim 3, wherein said structure of said molded edge is capable of attaching to a filter.

5. The channeled glass envelope of claim 3, wherein said structure of said molded edge is capable of attaching to a liquid crystal display screen.

6. The channeled glass envelope of claim 2, wherein said molded edge has a multiple step structure.

7. The channeled glass envelope of claim 6, wherein said structure of said molded edge is capable of attaching to a filter and a liquid crystal display screen.

8. The channeled glass envelope of claim 6, wherein said structure of said molded edge is capable of attaching to two filters.

9. The channeled glass envelope of claim 1, wherein said channeled envelope further comprises attachment supports integral with said channeled envelope.

10. The channeled glass envelope of claim 1, wherein said channeled envelope is composed of a transparent material selected from the group of glasses consisting of soda-lime silicate, borosilicate, aluminosilicate and boroaluminosilicate.

11. A light-emitting device comprising a channeled glass envelope having a front and back surface laminated and integrated together to form a unitary body essentially free of any sealing materials, said channeled envelope comprising a gas-discharge channel and a molded edge having a structure having at least one step and/or at least one part protruding upward and/or downward relative to the lamp body capable of affixing attachments, said edge being essentially the peripheral portion of the lamp envelope, said gas-discharge channel provided with an ionizable gas and electrodes in communication with, and located at opposite ends of said gas-discharge channel, for generating a glow-discharge therebetween.

12. The light-emitting device of claim 11, wherein said structure of said molded edge is capable of attaching to a filter to said light-emitting device.

13. The light-emitting device of claim 11, wherein said structure of said molded edge is capable of attaching to a LCD screen to said light-emitting device.

14. The light-emitting device of claim 11, wherein said electrodes are internal.

15. The light-emitting device of claim 11, wherein said electrodes are external.

16. The light-emitting device of claim 11, wherein said light-emitting device is a neon lamp.

17. The light-emitting device of claim 11, wherein said light-emitting device is a fluorescent lamp.

* * * * *